United States Patent [19]

Lombardino et al.

[11] Patent Number: 5,009,561

[45] Date of Patent: Apr. 23, 1991

[54] REAGENT TABLET DISPENSER

[75] Inventors: Paul A. Lombardino, Warren; Ronald L. Saxon, Stephensburg; Dennis W. Supchak, Bloomfield, all of N.J.

[73] Assignee: Pharmacia Diagnostics Inc., Fairfield, N.J.

[21] Appl. No.: 395,608

[22] Filed: Aug. 18, 1989

[51] Int. Cl.[5] ..... B65D 83/04

[52] U.S. Cl. ..... 414/412; 83/165; 221/25

[58] Field of Search ..... 414/411, 412; 221/25, 221/30, 31; 83/162, 165, 452, 459

[56] References Cited

U.S. PATENT DOCUMENTS

| | | | |
|---|---|---|---|
| 1,352,378 | 9/1920 | Postma | 414/412 |
| 2,082,922 | 6/1937 | Vitek | 414/412 X |
| 3,078,008 | 2/1963 | MacDonald | 221/31 |
| 3,538,799 | 11/1970 | Orlando | 83/459 X |
| 3,739,471 | 6/1973 | Peres | 414/412 X |
| 4,096,945 | 6/1978 | Melton et al. | 221/25 X |
| 4,155,483 | 5/1979 | Bartlett et al. | 222/1 |
| 4,428,709 | 1/1984 | Peters | 414/412 |
| 4,469,722 | 9/1984 | Danielson et al. | 221/31 X |
| 4,627,432 | 12/1986 | Newell et al. | 221/30 X |
| 4,733,797 | 3/1988 | Haber | 221/25 X |
| 4,778,054 | 10/1988 | Newell et al. | 206/531 |

FOREIGN PATENT DOCUMENTS

| | | | |
|---|---|---|---|
| 0305895 | 3/1989 | European Pat. Off. | 221/25 |
| 3317549 | 11/1984 | Fed. Rep. of Germany | 414/411 |

*Primary Examiner*—Robert J. Spar
*Assistant Examiner*—John Van den Bosche
*Attorney, Agent, or Firm*—Davis Hoxie Faithfull & Hapgood

[57] ABSTRACT

A tablet dispenser is described for dispensing tablets from individual packets into a small reaction chamber without contamination. The dispenser has a top shaft, and a thumb piece in which a cutting blade is engaged, the thumb piece being slidably mounted on the shaft. There is also provided a plate having a hole adapted to allow the blade to pass therethrough, the plate being connected to the top shaft by a support member, and a bottom shaft extending underneath the hole and in line with the cutting blade and top shaft. The bottom shaft is connected to the plate. Also provided is a clip for holding a package containing a tablet on top of the plate so that the package can be positioned to align the tablet over the hole and in the non-cutting path of the blade. When the thumb piece is depressed the tablet is released from the package and falls down the bottom shaft and into a reaction vessel placed below the bottom shaft.

27 Claims, 2 Drawing Sheets

REAGENT TABLET DISPENSER

FIELD OF THE INVENTION

The instant invention is in the field of devices for dispensing tablets. In particular, the invention concerns a dispenser which is especially useful for dispensing an individually sealed tablet from its package into a small container such as a cuvette.

BACKGROUND OF THE INVENTION

Tablets are now available which provide an improved means for performing experiments or analyses using premeasured amounts of reagents. The tablets can be added to reaction chambers, containing, for example an analyte such as serum, and measurements taken without any metering of liquid reagents. Tablets are manufactured by the American Dade division of American Hospital Supply Corporation which can be employed in testing for a variety of analytes in serum. In one commercial application designed for hospital and clinical laboratory use, the tablets are used in a large scale analyzing system which employs a cuvette belt into which the tablets are dispensed. The dispensing apparatus for this system carries many tablets and has an elaborate mechanism enabling one tablet to be dispensed at a time.

The tablets may also be used, however, in a smaller scale environment, such as a doctor's office, where they are individually packaged. Such individual packaging is required in order to maintain freshness of the reagents where the time between analyses is much longer than for larger scale users such as hospitals and laboratories. There exists a need for a tablet dispenser which is able to dispense reagent tablets from a sealed package such that the tablet is not contaminated by manual handling, and so that the tablet can be easily released into a reaction chamber, such as a cuvette.

SUMMARY OF THE INVENTION

A tablet dispenser is described herein which has a top shaft, and a thumb piece in which a cutting blade is engaged, the thumb piece being slidably mounted on the shaft. There is also provided a plate having a hole adapted to allow the blade to pass therethrough, the plate being connected to the top shaft by a support member, and a bottom shaft extending underneath the hole and in line with the cutting blade and top shaft. The bottom shaft is connected to the plate. Also provided are means for holding a package containing a tablet on top of the plate so that the package can be positioned to align the tablet over the hole and in the non-cutting path of the blade. When the thumb piece is depressed the tablet is released from the package and falls down the bottom shaft and into a reaction vessel placed below the bottom shaft. Preferably the blade is hollow and has a member therein adapted to push the tablet out of the package after it is cut. Preferably the blade has a retracted section which does not cut the package when the thumb piece is pressed, thereby leaving the cut section of the package attached while allowing the tablet to be released.

DETAILED DESCRIPTION OF THE INVENTION

Figure 1:
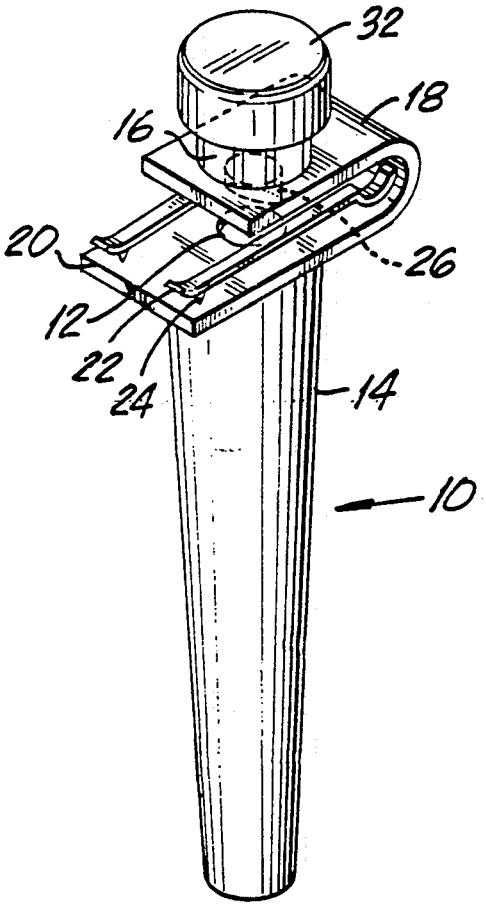
FIG. 1 is a perspective view of the tablet dispenser.
Figure 2:
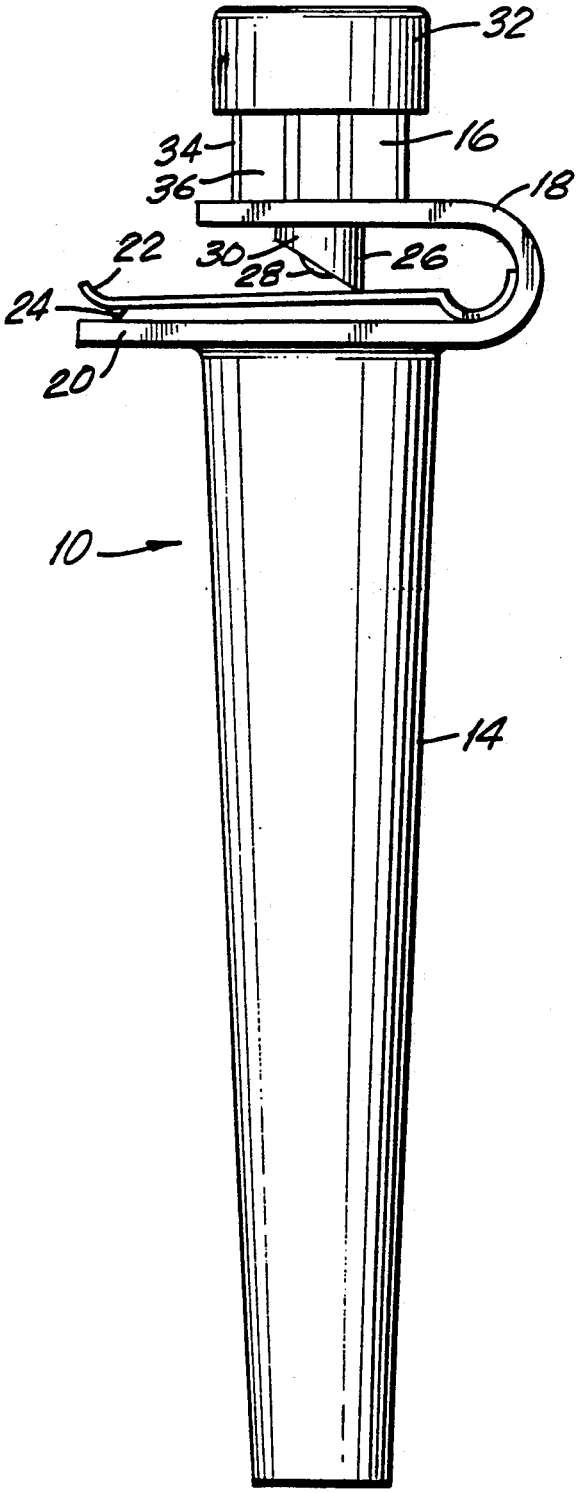
FIG. 2 is a side view of the tablet dispenser.

Referring now to FIG. 1, the dispenser 10 of the invention allows for the easy positioning of a package containing a tablet reagent over a hole 12 in the dispenser. The hole 12 leads to a shaft 14 through which the tablet will fall and be directed to a reaction chamber, such as a cuvette, below.

The top shaft 16 can be attached to the plate 20 having the hole in it by a support member 18 which supports the top shaft. The invention contemplates the use of any support member which supports the top shaft over the hole without interfering with the positioning of a tablet package on the plate. The support member is preferably adapted to allow one to view the tablet within the package as it is positioned over the hole.

The means for holding the package on the plate may be any device capable of holding the tablet package over the hole. Clamps, for example, may be used. In a preferred embodiment, clips 22 are mounted on the plate 20, the clips 22 being biased so that they will press against the top of a tablet package placed on the plate. The clips 22 may be so biased, by mounting them in a "U" shaped surface formed by the member 18 connecting the top shaft to the plate. The clips may have bumps 24 on their underside, or similar means to increase the bias against the package, and to localize the holding pressure of the clips on the package.

The package which the positioning means is adapted to hold may be any shape. However, generally, it will be a flat package made of paper, or aluminum backings which the blade will be able to penetrate. The perimeter of the package can be square, rectangular, or round. A square package provides a preferable shape for positioning on the plate of the dispenser. Preferably the tablet will be positioned in the middle of the package to enable easier positioning of the tablet over the hole. However, if the tablet is off center, the package may easily be moved to properly position the tablet.

The blade employed may be in any suitable shape and may be hollow or solid. Preferably, however, a hollow blade 26 is employed having a member therein 28 which pushes out the tablet when the package is cut. The member may be, for example, made of soft rubber material which provides a retaining wall inside the hollow cutting blade to prevent the tablet from travelling vertically up the blade during the cutting action The blade preferably is cylindrical, thereby matching in shape tablets which are currently marketed and which are circular in cross section.

The blade also preferably has a cut-out or retracted section 30 which enables the blade to cut through the package while leaving a connecting piece on both sides of the package which prevents the cut-out pieces from also falling down the hole. For example, the blade may have a cylindrical shape, with a retracted area 30 which does not penetrate the package when the thumb piece is pressed. Other embodiments having a retracted section are possible. For example, the hollow cylinder shown could form an incomplete circumferential blade wherein there is no cutting part at all where the packaging is to remain attached.

The thumb piece 32 is slidably mounted on the top shaft by any suitable sliding mechanism. Preferably, the thumb piece and the top shaft have mating grooves and protrusions 34, 36 which extend along the longitudinal axes of the shaft and thumb piece in order to slidably mount the thumb piece on the top shaft. Other means of accomplishing the same end will be apparent to one skilled in the art. For example, grooves may extend along the longitudinal axis of the top shaft, which mate with protrusions extending from an annular ring inside the bottom end of the thumb piece.

Figure 3:
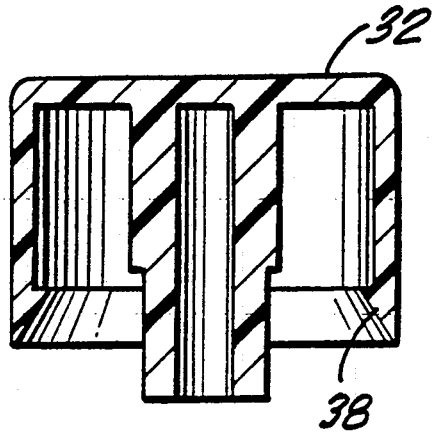
FIG. 3 is a side cross sectional view of the thumb piece.
Figure 4:
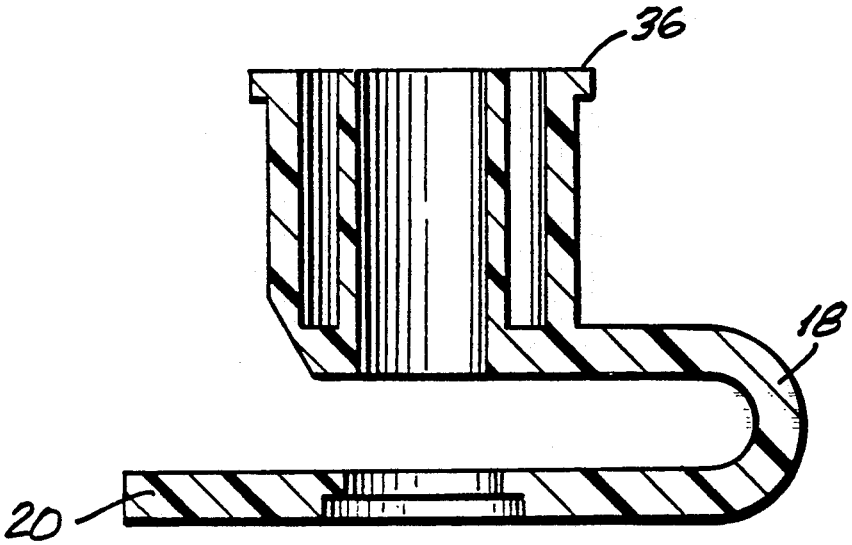
FIG. 4 is a side cross sectional view of the top shaft, support member and plate.

Additionally, the top shaft and thumb piece should have some means for preventing them from disengaging from each other. Preferably, as in FIG. 4, there is a first annular stop piece 36 at a top end of the top shaft. The thumb piece, as in FIG. 3, has a second annular stop piece 38 at a bottom end of the thumb piece, and the first and second circumferential stop pieces are adapted to prevent the thumb piece from sliding off the end of the top shaft. Preferably the first and second annular stop pieces are adapted to snap over one another for easy assembly The bottom shaft 14 may be of cylindrical shape, and is preferably in an inverted frustoconical shape. Since the dispenser is designed particularly for use in dispensing tablets into a small reaction chamber, it is preferred that the bottom end of the shaft be adapted to fit into a chamber no more than about 15 mm wide.

It is contemplated that the dispenser can be manufactured out of any suitable material, such as plastic or stainless steel.

We claim:

1. A tablet dispenser which dispenses a tablet from a package which has two layers of packaging material which comprises (a) a top shaft;

(b) a thumb piece in which an anular hollow inclined blade having a retracted portion is engaged, said thumb piece being slidably mounted on said shaft, and said blade being adapted to penetrate a generally flat package placed below the blade and to release a tablet from said package while said retracted portion leaves an incompletely cut out hole in both sides of said package;

(c) a plate having a hole adapted to allow the blade to pass therethrough, said plate being connected to the top shaft by a support member;

(d) a bottom shaft extending underneath the hole and in line with the cutting blade and top shaft, said bottom shaft being connected to the plate; and (e) means for holding a package containing a tablet on top of the plate so that the package can be positioned in order to align the tablet over the hole and in the path of the blade.

2. The dispenser of claim 1 further comprising spring means for returning the thumb piece to its original position after it is pressed.

3. The dispenser of the claim 1 wherein the bottom shaft has an inverted frustoconical shape.

4. The dispenser of claim 3 wherein the bottom shaft has a bottom end which is adapted to fit into an opening of a reaction chamber which is no more than about 15 mm wide.

5. The dispenser of claim 1 wherein the top shaft and the thumb piece have mating grooves and protrusions in order to slidably mount the thumb piece on the top shaft.

6. The dispenser of claim 1 wherein the top shaft has a first circumferential stop piece at a top end of the top shaft, and the thumb piece has a second circumferential stop piece at a bottom end of the thumb piece, the first and second circumferential stop pieces adapted to prevent the thumb piece from sliding off the top end of the top shaft.

7. The dispenser of claim 1 wherein the supporting member is adapted to allow one to view the tablet within the package as it is placed over the hole.

8. A tablet dispenser which dispenses a tablet from a package which has two layers of packaging material which comprises (a) a top shaft;

(b) a thumb piece in which an anular hollow inclined blade is engaged, said thumb piece being slidably mounted on said shaft;

(c) a plate having a hole adapted to allow the blade to pass therethrough, said plate being connected to the top shaft by a support member;

(d) a bottom shaft extending underneath the hole and in line with the cutting blade and top shaft, said bottom shaft being connected to the plate; and (e) means for holding a generally flat package containing a tablet on top of the plate so that the package can be positioned in order to align the tablet over the hole and in the path of the hollow of the cutting blade;

said cutting blade having a retracted part on the blade's cutting edge which, when the thumb piece is actuated, leaves an incompletely cutout hole in both sides of the tablet package.

9. The dispenser of claim 8 further comprising a member within the hollow of the blade positioned so as to push the tablet in the package out of the package and into the hole when the package is cut by the blade.

10. The dispenser of claim 8 further comprising spring means for returning the thumb piece to its original position after it is pressed.

11. The dispenser of the claim 8 wherein the bottom shaft has an inverted frustoconical shape.

12. The dispenser of claim 11 wherein the bottom shaft has a bottom end which is adapted to fit into the opening of a reaction chamber which is no more than about 15 mm wide.

13. The dispenser of claim 8 wherein the top shaft has a cutout section adapted to enable one to view a tablet placed in the center of the tablet package when the tablet is positioned over the hole.

14. The dispenser of claim 8 wherein the top shaft and the thumb piece have mating grooves and protrusions in order to slidably mount the thumb piece on the top shaft.

15. The dispenser of claim 8 wherein the top shaft has a first circumferential stop piece at a top end of the top shaft, and the thumb piece has a second circumferential stop piece at a bottom end of the thumb piece, the first and second circumferential stop pieces adapted to prevent the thumb piece from sliding off the top end of the top shaft.

16. The dispenser of claim 8 wherein the supporting member is adapted to allow one to view the tablet within the package as it is placed over the hole.

17. A tablet dispenser which dispenses a tablet from a package which has two layers of packaging material which comprises (a) a top shaft;

(b) a thumb piece in which an anular hollow inclined blade is engaged, said thumb piece being slidably mounted on said shaft;

(c) a plate having a hole adapted to allow the blade to pass therethrough, said plate being connected to the top shaft by a support member;

(d) a bottom shaft extending underneath the hole and in line with the cutting blade and top shaft, said bottom shaft being connected to the plate; and (e) a clip biased against the plate for positioning a generally flat package containing a tablet on top of the plate so that the tablet is aligned with the hole and is in the path of the hollow of the blade;

said cutting blade having a retracted part on the blade's cutting edge which, when the thumb piece is actuated, leaves an incompletely cutout hole in both sides of the tablet package.

18. The dispenser of claim 17 further comprising a member within the hollow of the blade positioned so as to push the tablet in the package out of the package and into the hole when the package is cut by the blade.

19. The dispenser of claim 17 wherein the support member has substantially a "U" shape at a point where it connects with the plate and wherein the clip has a first end which is adapted to be fitted in a compressed manner into the "U" shape of the member connecting the plate to the top shaft, and further wherein the clip has a second end which is biased to hold down the package.

20. The dispenser of claim 17 wherein the clip has a bump protruding from its underside in contact with the package.

21. The dispenser of claim 17 further comprising spring means for returning the thumb piece to its original position after it is pressed.

22. The dispenser of the claim 17 wherein the bottom shaft has an inverted frustoconical shape.

23. The dispenser of claim 22 wherein the bottom shaft has a bottom end which is adapted to fit into the opening of a reaction chamber which is no more than about 15 mm wide.

24. The dispenser of claim 17 wherein the top shaft and the thumb piece have mating grooves and protrusions in order to slidably mount the thumb piece on the top shaft.

25. The dispenser of claim 17 wherein the top shaft has a first circumferential stop piece at a top end of the top shaft, and the thumb piece has a second circumferential stop piece at a bottom end of the thumb piece, the first and second circumferential stop pieces adapted to prevent the thumb piece from sliding off the top end of the top shaft.

26. The dispenser of claim 17 wherein the blade is substantially in the shape of a cylinder.

27. The dispenser of claim 17 wherein the supporting member is adapted to allow one to view the tablet within the package as it is placed over the hole.

* * * * *